US006194034B1

(12) United States Patent
Nishi et al.

(10) Patent No.: US 6,194,034 B1
(45) **Date of Patent: *Feb. 27, 2001**

(54) METHOD OF COATING A SUBSTRATE WHEREIN THE FLOW RATE OF THE COATING SOLUTION IS CHANGED

(75) Inventors: Yasuo Nishi; Tomohiko Sakai; Nobuhiro Ueno; Nobuyuki Kimura; Fumio Kimura, all of Hino (JP)

(73) Assignee: Konica Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/108,074

(22) Filed: Jun. 30, 1998

(30) Foreign Application Priority Data

Jul. 2, 1997 (JP) ..... 9-176897

(51) Int. Cl.[7] ..... B05D 1/34

(52) U.S. Cl. ..... 427/402; 427/420; 118/411; 118/DIG. 4

(58) Field of Search ..... 427/402, 420; 118/411, 410, DIG. 4

(56) References Cited

U.S. PATENT DOCUMENTS

| | | | |
|---|---|---|---|
| 3,903,843 | 9/1975 | Jones | 118/410 |
| 4,001,024 | 1/1977 | Dittman et al. | 427/402 |
| 4,297,396 | 10/1981 | Takehara et al. | 427/284 |
| 4,313,980 | 2/1982 | Willemsens | 427/402 |
| 4,877,639 * | 10/1989 | Willemsens et al. | 427/420 |
| 5,143,758 | 9/1992 | Devine | 427/420 |

FOREIGN PATENT DOCUMENTS

| | | |
|---|---|---|
| 0261613 | 3/1988 | (EP) . |
| 0300098 | 1/1989 | (EP) . |
| 0439172 | 7/1991 | (EP) . |
| 8-089886 * | 4/1996 | (JP) . |

* cited by examiner

*Primary Examiner*—Katherine A. Bareford
(74) *Attorney, Agent, or Firm*—Jordan B. Bierman; Bierman, Muserlian and Lucas

(57) ABSTRACT

A method of coating a coating solution onto a base member by a coater while conveying the base member, wherein the base member has a coating starting point from which the coating solution is coated onto the base member, comprise steps of feeding the coating solution to the coater at a flow rate lower than a regular coating flow rate; and increasing the lower flow rate to the regular coating flow rate in accordance with the conveyed position of the coating starting point of the base member when the coating starting point of the base member is conveyed to the coater.

25 Claims, 4 Drawing Sheets

FIG. 3 ( a )
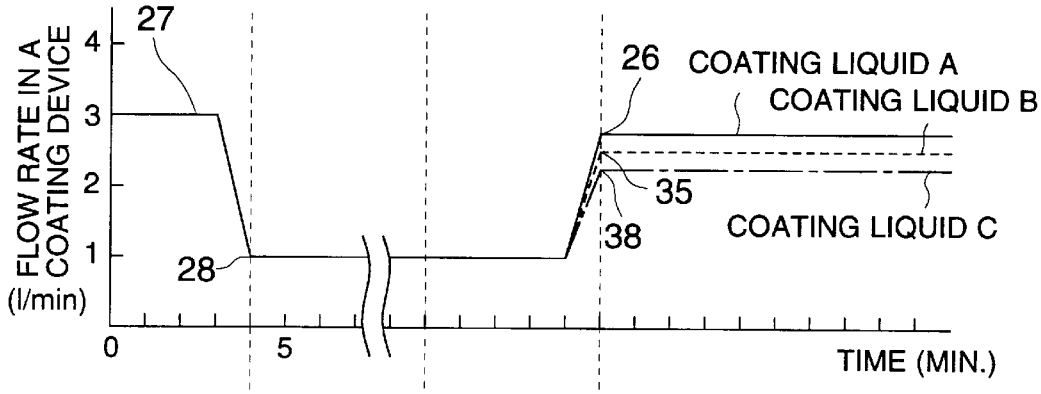
FIG. 3 ( b )
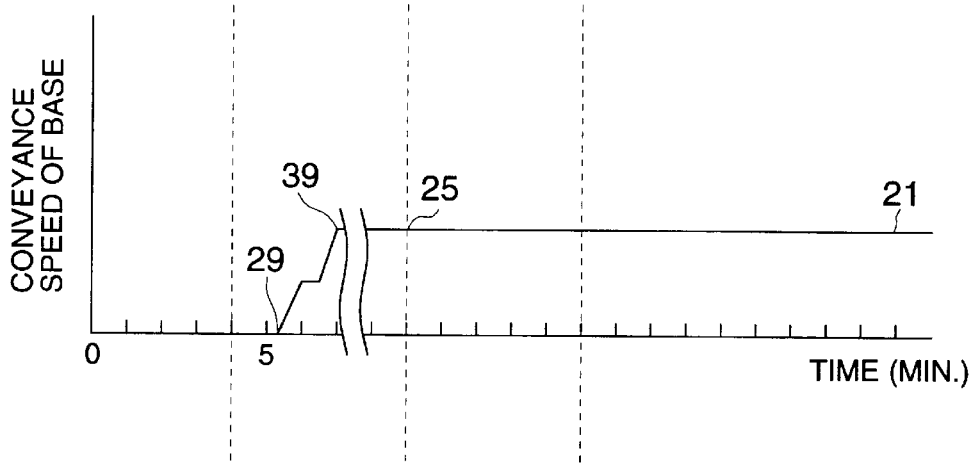

FIG. 4 ( a )
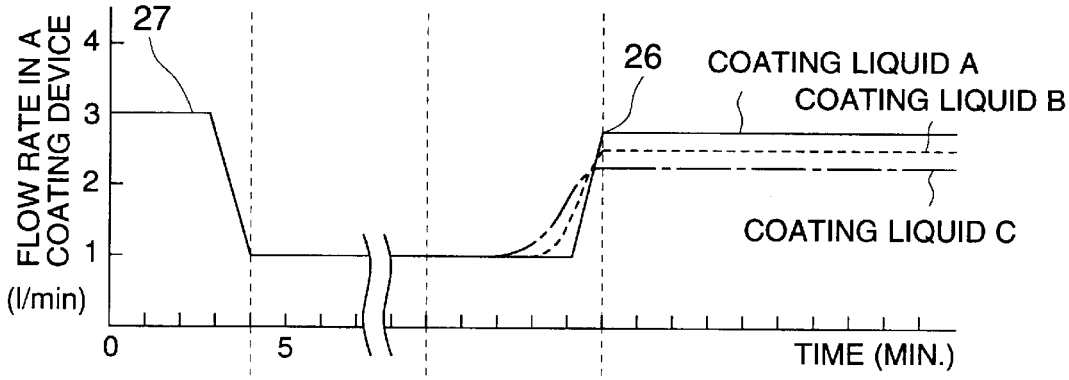
FIG. 4 ( b )
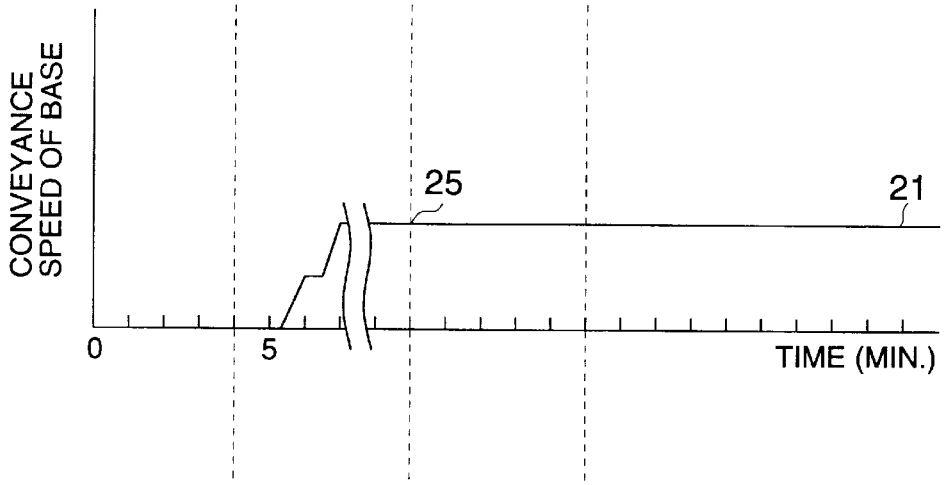

METHOD OF COATING A SUBSTRATE WHEREIN THE FLOW RATE OF THE COATING SOLUTION IS CHANGED

BACKGROUND OF THE INVENTION

The present invention relates to a coating method which coats a coating liquid or a coating solution onto a conveyed base member to be coated and to a coating system.

Heretofore, in order to conduct a coating preparation operation while a coating liquid is flowed out when the coating liquid is coated onto a conveyed base member by means of a coater (for example, in the case of a slide hopper coater, in order to conduct equalization of the slit outlet port in such a manner that the coating liquid is uniformly coated from slit of coater 8 and cleaning of the drop of excessive coating liquid from lip of coater 8 while flowing out the coating liquid), prior to coating the coating liquid onto the base member, the coating liquid is caused to flow out from the coater without coating the coating liquid onto the base member. Therefore, during conducting the coating preparation operation while flowing out the coating liquid from the coater, the coating liquid continues to flow out from the coater. After the coating preparation operation is finished, the base member is conveyed. When the coating starting point of the base member reaches the coater, coating of the coating liquid onto the base member starts.

Heretofore, the flow rate of the coating liquid while conducting the coating preparation operation and until the coating starting point of the base member reaches the coater was the same as coating flow rate.

The coating liquid flowing out during conducting the coating preparation operation is finally discarded. Since the feeding flow rate of the coating liquid while conducting the coating preparation operation was the same as the coating flow rate, there was a problem that loss of expensive coating liquid became large.

The leading portion of the base member is ordinarily a leader for feeding an area of the base member in which the coating liquid is coated at the coating flow rate along with a conveyance path. It is not ordinarily coated. Accordingly, the coating liquid fed until the coating starting point of the above-mentioned base member reaches the coater becomes loss. If the coating liquid is fed to the coater at the same feeding flow rate as the coating flow rate, loss of expensive coating liquid is further increased.

Therefore, if feeding of the coating liquid is stopped since the coating preparation operation is conducted until the coating starting point of the base member reaches the coater in order to prevent increase of the loss of the coating liquid, excessive drop occurs on the lip of the coater or the coating liquid cannot be fed from the slit of the coater. Therefore, feeding of the coating liquid cannot be stopped until the coating starting point of the base member reaches the coater.

SUMMARY OF THE INVENTION

The present invention was attained viewing the above-mentioned situation. An objective of the present invention is to reduce the loss of the coating liquid since the coating preparation operation is conducted until the coating starting point of the base member reaches the coater.

An object of the present invention is attained by each item mentioned below.

Item 1: A coating method which coats a coating liquid onto a conveyed base member by means of a coater, wherein the feeding flow rate of the above-mentioned coating liquid onto the above-mentioned coater is lowered compared with ordinary coating flow rate until the coating starting point of the above-mentioned base member which is a leading point of an area where the above-mentioned coating liquid is coated at the coating flow rate reaches the above-mentioned coater and the feeding flow rate of the above-mentioned coating liquid onto the above-mentioned coater is increased to the above-mentioned coating flow rate in accordance with that the coating starting point of the above-mentioned base member reaches the above-mentioned coater.

Owing to the invention described in Item 1, loss of the coating liquid since the coating preparation operation is conducted until the coating starting point of the base member reaches the coater can be reduced.

Item 2: A coating method which coats a coating liquid with plural layers onto a base member conveyed by means of a coater, wherein the feeding flow rate of at least one layer composing the coating liquid among the above-mentioned plural layers onto the above-mentioned coater is lowered compared with coating flow rate until the coating starting point of the above-mentioned base member which is a leading point of an area where the above-mentioned coating liquid is coated at the coating flow rate reaches the above-mentioned coater and the feeding flow rate of the above-mentioned coating liquid with plural layers onto the above-mentioned coater is increased to the above-mentioned coating flow rate in accordance with that the coating starting point of the above-mentioned base member reaches the above-mentioned coater.

Owing to the invention described in Item 2, loss of the coating liquid since the coating preparation operation is conducted until the coating starting point of the base member reaches the coater can be reduced easily.

Item 3: The coating method described in Item 2 wherein the feeding flow rate of coating liquids for layers, whose flow rate is set to be lower compared to the coating flow rate between the coating starting point of the above-mentioned base member as the coating starting point of the above-mentioned base member reaches the above-mentioned coater, is simultaneously increased.

Owing to the invention described in Item 3, loss of the coating liquid since the coating preparation operation is conducted until the coating starting point of the base member reaches the coater can be reduced easily.

Item 4: The coating method described in Item 2 or 3, wherein the feeding flow rate of the coating liquid for the above-mentioned uppermost layer onto the above-mentioned coater is set to be the coating flow rate and the feeding flow rate of the coating liquid for the layers other than the uppermost layers is set to be lower than the coating flow rate until the coating starting point of the above-mentioned base member reaches the above-mentioned coater and the feeding flow rate of the coating liquid for the above-mentioned plural layers reaches the coating flow rate as the coating starting point of the above-mentioned base member reaches the above-mentioned coater.

Due to the feeding flow rate of the coating liquid for the above-mentioned uppermost layer onto the above-mentioned coater is set to be the coating flow rate until the coating starting point of the above-mentioned base member reaches the above-mentioned coater and the feeding flow rate of the coating liquid for the layers other than the uppermost layer is set to be lower than the coating flow rate until the coating starting point of the above-mentioned base member reaches the above-mentioned coater while the pulling phenomenon on the uppermost layer is prevented. Therefore, loss of the coating liquid until the coating starting point of the base member reaches the coater can be reduced easily.

Item 5: The coating method described in any of Items 2 through 4, wherein the above-mentioned feeding flow rate of the coating liquid for plural layers is controlled by controlling a pump, which feeds the above-mentioned coating liquid for each layer, provided for each of the above-mentioned plural layers.

Owing to the invention described in Item 5, the feeding flow rate onto the coater by means of the pump is controlled. Therefore, time since the feeding flow rate, which is relatively lower, was increased until it reaches the coating flow rate can be shortened.

Item 6: The coating method described in any of Item 1 through 5, wherein the above-mentioned coater is withdrawn from the coater coating position before the coating starting point of the above-mentioned base member reaches the above-mentioned coater and the above-mentioned coater is caused to automatically advance to the above-mentioned coater coating position as the coating starting point of the above-mentioned base member reaches the above-mentioned coater.

Owing to the invention described in Item 6, loss of the coating liquid can further be decreased.

Item 7: A coating system comprising a conveyance means which conveys a base member, a coater which coats a coating liquid onto the above-mentioned base member conveyed by the above-mentioned conveyance means and a feeding flow rate control means which controls the feeding flow rate of the above-mentioned coating liquid onto the above-mentioned coater, wherein the above-mentioned feeding flow rate control means controls in such a manner that the above-mentioned feeding flow rate onto the above-mentioned coater is lower than the coating flow rate before the above-mentioned coating starting point of the above-mentioned base member reaches the above-mentioned coater and that the above-mentioned feeding flow rate of the above-mentioned coating liquid onto the above-mentioned coater is increased to the coating flow rate as the feeding flow rate of the above-mentioned coating liquid is increased to the coating flow rate.

Owing to the invention described in Item 7, loss of the coating liquid since the coating preparation operation is conducted until the coating starting point of the base member reaches the coater.

Item 8: A coating system comprising a conveyance means which conveys a base member, a coater which coats a coating liquid with plural layers onto the above-mentioned base member conveyed by the above-mentioned conveyance means and a feeding flow rate control means which controls the feeding flow rate of the above-mentioned coating liquid with plural layers onto the above-mentioned coater, wherein the above-mentioned feeding flow rate control means controls in such a manner that the above-mentioned feeding flow rate of at least one layer among the above-mentioned plural layers of the coating liquid onto the above-mentioned coater is lower than the coating flow rate before the above-mentioned coating starting point of the above-mentioned base member reaches the above-mentioned coater and that the above-mentioned feeding flow rate of the above-mentioned coating liquid onto the above-mentioned coater is increased to the coating flow rate as the feeding flow rate of the above-mentioned coating liquid with plural layers reaches the coating flow rate as the coating starting point of the above-mentioned base member reaches the above-mentioned coater.

Owing to the invention described in Item 8, loss of the coating liquid since the coating preparation operation is conducted until the coating starting point of the base member reaches the coater.

Item 9: The coating system described in Item 8 wherein the above-mentioned feeding flow rate control means controls in such a manner that the feeding flow rate of the coating liquid for all layers whose feeding flow rate was set to be lower compared with the coating flow rate is simultaneously increased before the coating starting point of the above-mentioned base member reaches the above-mentioned coater.

Owing to the invention described in Item 9, loss of the coating liquid since the coating preparation operation is conducted until the coating starting point of the base member reaches the coater is reduced0.

Item 10: The coating system described in Item 8 or 9, wherein the above-mentioned feeding flow rate control means controls in such a manner that the feeding flow rate of the coating liquid for the above-mentioned uppermost layer onto the above-mentioned coater is set to be the coating flow rate and that the feeding flow rate of the coating liquid for the layers other than the uppermost layer is set to be lower than the coating flow rate and also controls that the feeding flow rate of the coating liquid for the plural of the above-mentioned layers reaches the coating flow rate as the coating starting point of the above-mentioned base member reaches the above-mentioned coater.

Due to the feeding flow rate of the coating liquid for the above-mentioned uppermost layer onto the above-mentioned coater is set to be the coating flow rate until the coating starting point of the above-mentioned base member reaches the above-mentioned coater and the feeding flow rate of the coating liquid for the layers other than the uppermost layer is set to be lower than the coating flow rate until the coating starting point of the above-mentioned base member reaches the above-mentioned coater while the pulling phenomenon on the uppermost layer is prevented. Therefore, loss of the coating liquid until the coating starting point of the base member reaches the coater can be reduced easily.

Item 11: The coating system described in any of Items 8 through 10, wherein the above-mentioned feeding flow rate control means incorporates a pump which feeds the above-mentioned coating liquid for each layer and it controls the feeding flow rate of the coating liquid for plural of the above-mentioned layers due to controlling each pump.

Owing to the invention described in Item 11, feeding flow rate onto the coater by means of the pump can be controlled. Therefore, time since the feeding flow rate relatively lower was increased until the feeding flow rate reaches the coating flow rate can be shortened. In addition, loss of the coating liquid until the coating starting point of the above-mentioned base member reaches the coater can further be reduced.

Item 12: The coating system described in any of Items 7 through 11 having a coating position control means which causes the above-mentioned coater to advance to the coater coating position or to withdraw it from the above-mentioned coater coating position, wherein the above-mentioned coater is caused to advance to the above-mentioned coater coating position as the coating starting point of the above-mentioned base member reaches the above-mentioned coater.

Owing to the invention described in Item 12, loss of the coating liquid can be reduced.

Item 13: The coating system described in either of Items 7 through 12 having a coating starting point sensing means which senses passage of the coating starting point of the above-mentioned base member on upstream side of the conveyance direction by means of the above-mentioned conveyance means compared with the above-mentioned coater, wherein the feeding flow rate of the coating liquid onto the above-mentioned coater is controlled based on the above-mentioned coating starting point sensed by means of the above-mentioned coating starting point sensing means.

Owing to Item 13, timing to set the feeding flow rate of the coating liquid onto the coater becomes closer to time when the coating starting point of the base member reaches the coater. Therefore, the amount of the waste of the base member and the coating liquid becomes further reduced.

Explanation of Terminology

"Base member" represents a medium, a support or a member to be coated, such as a web, a sheet or a drum. In the present invention, a web-shaped base is preferable. In addition, the base member includes a base connected with a leader for conveyance.

"Coating starting point " is "the leading point of the area in which the coating liquid is coated at the coating flow rate" of the base member. If the base member is a base connected with a leader for conveyance, it is the most preferable to decide the joint portion between the base and the leader for conveyance as the coating starting point. In addition, the coating starting point may be located on the base, and it may be located on the leader for conveyance. In such cases, a portion as close as possible to the joint portion is preferable since loss is small. In addition, if the base member is composed only of the base, it goes without saying that a prescribed position on the base is defined to be the coating starting point (the leading portion of the base is also allowed).

It is preferable to provide something like a mark for the coating starting point in such a manner that sensing is easy. If the mark is not provided, the coating starting point may be judged by conveyance distance.

A phrase of "when the coating starting point of the base member is conveyed to the coater" means "at the same time as" or "after reaching". It is the most preferable to be at the same time as the coating starting point reaches the coater. In the case of "after reaching", it is preferable as short as aforesaid time is. If the time can be included in error range, it is allowed to be before reaching.

"Coater coating position" is a position of a coater when the coater coats the coating liquid onto the base member.

"Coating flow rate" is feeding flow rate of the coating liquid onto the coater when the coating liquid is coated onto the base member.

BRIEF DESCRIPTION OF THE DRAWINGS

FIGS. 3(*a*) and 3(*b*) are graphs showing change of the feeding flow rate of the coating liquid in the first control example of the coating system of an embodiment over time (a) and the change of the conveyance speed of base 15 over time (b).

FIGS. 4(*a*) and 4(*b*) are graphs showing change of the feeding flow rate of the coating liquid in the second control example of the coating system of an embodiment over time (a) and the change of the conveyance speed of base 15 over time (b).

DETAILED DESCRIPTION OF THE PREFERRED EMBODIMENT

Hereinafter, one example of an embodiment of the present invention is exhibited as an embodiment. However, the present invention is not limited thereto. In addition, the following embodiments show preferable examples of the present invention. They do not limit meaning of the term or technical scope of the present invention.

Embodiment

Figure 1:
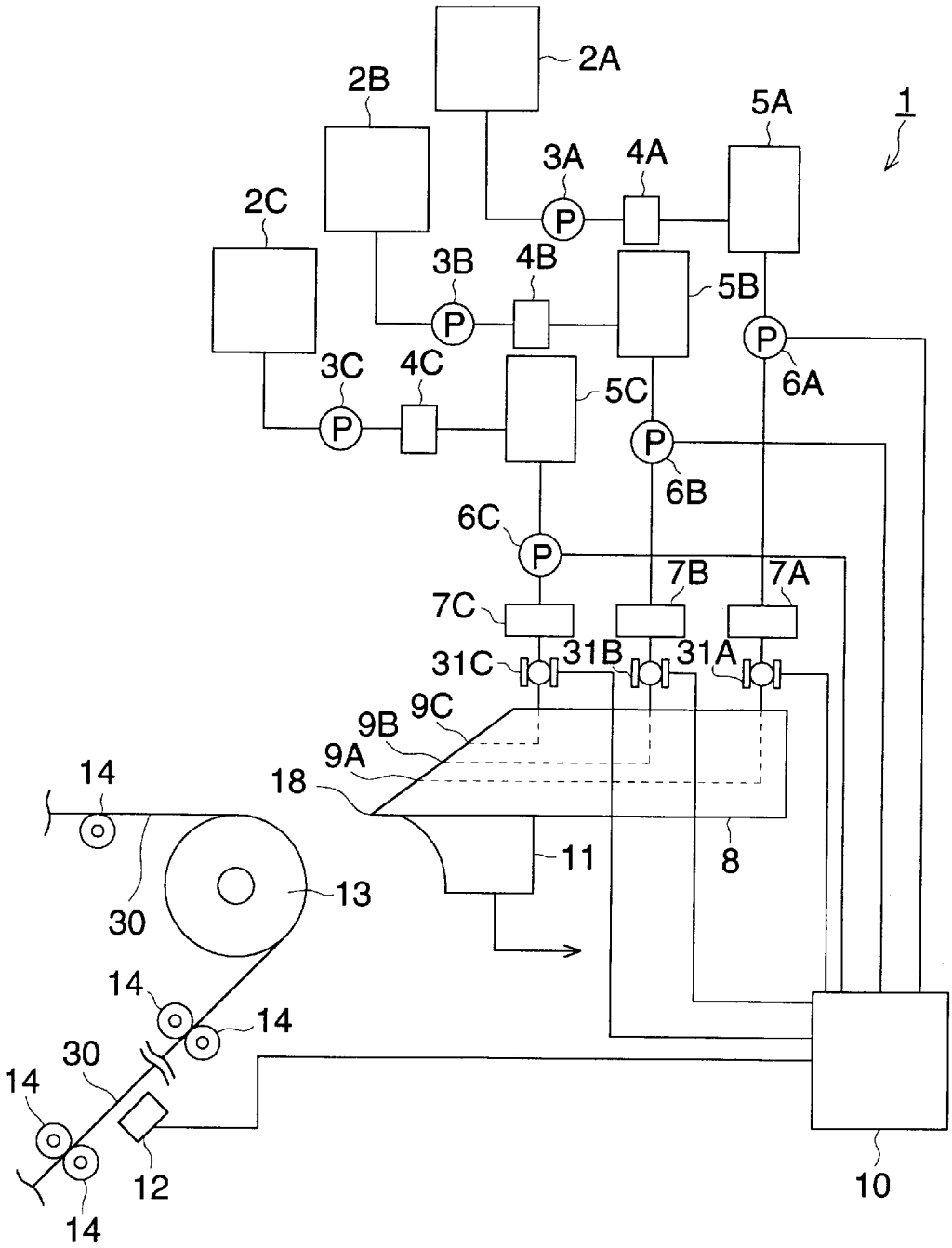
FIG. 1 is a schematic block diagram during coating preparation operation of the coating system.
Figure 2:
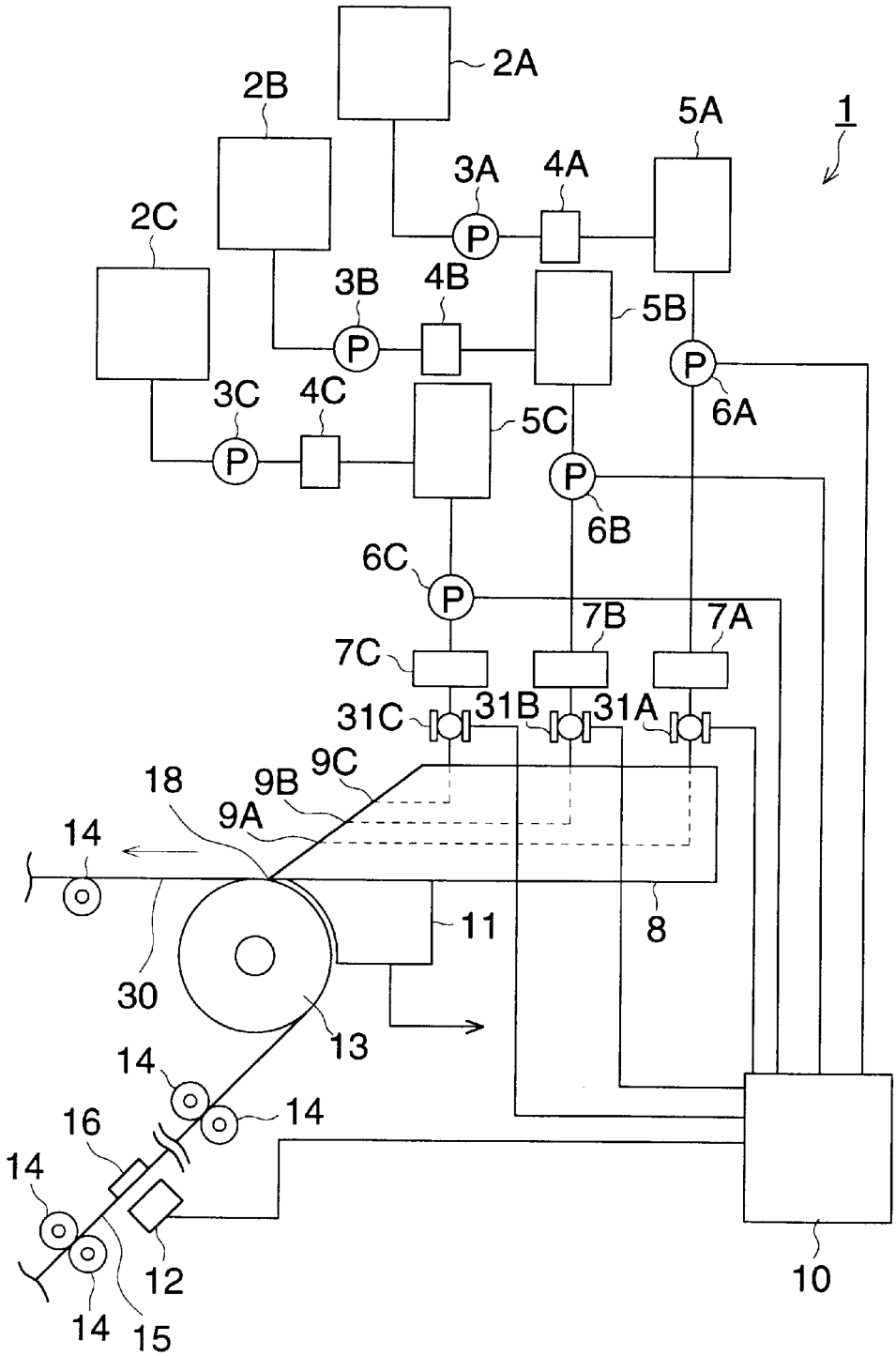
FIG. 2 is a schematic block diagram when the coating liquid in the coating system is coated.

In coating system 1 of the present embodiment, a coating liquid having plural layers (three layers) which are different kinds of coating liquid each other is coated on base 15 which is a base member for forming a coating layer with a plural layers (three layers). Hereinafter, using FIGS. 1 through 4, a coating system of the present embodiment will be explained. FIG. 1 shows a schematic block diagram of the present embodiment during coating preparation operation. FIG. 2 is a schematic block diagram of the coating system of the present embodiment in which a coating liquid is coated on the base member. FIG. 3 is a graph showing change over time of the flow amount fed of a coating liquid onto coater 8 of first control example in a coating system of the present embodiment and change over time of conveyance speed of base 15 which is a base member. FIG. 4 is a graph showing change over time of the flow amount fed of a coating liquid onto coater 8 of second control example in a coating system of the present embodiment and change over time of conveyance speed of base 15 which is a base member. (a) and (b) in FIGS. 3 and 4 are related to each other. If the X-axis (time) is the same, it represents flow amount fed onto the coater and conveyance speed of base 15 at the same time.

In coating system 1 of the present embodiment, a coating liquid with plural layers is coated on a web continuously conveyed. Specifically, the present system is most suitable for producing a silver halide photographic light-sensitive material in which at least one of plural of aforesaid layers is a silver halide photographic emulsion (a liquid in which silver halide grains are dispersed in a gelatin solution) for silver halide photographic light-sensitive material. However, aforesaid system may be used for coating of other kinds of liquids.

From coating liquid tank 2A in which a coating liquid used for the lowermost coating layer (hereinafter, abbreviated as "coating liquid A"), coating liquid A is fed to filter 4A through a liquid feeding tube by means of liquid feeding pump 3A. Coating liquid A in which impurities such as dust were removed by means of filter 4A is sent to degassing tank 5A, where ultrasonic waves is irradiated into coating liquid A so that coating liquid A is degassed. Incidentally, degassing tank 5A also functions as a buffer tank.

Coating liquid A which was degassed in degassing tank 5A is regulated its flow amount fed by feeding back the values of flow rate meter 31A by means of fed flow amount control pump 6A (hereinafter, abbreviated as "control pump") which is one of a fed flow amount control means, and is sent to second filter 7A through the liquid feeding tube. Coating liquid A in which impurities such as dust was removed at second filter 7A is sent to coater 8. From slit outlet 9A for the coating liquid for the lowermost layer of the coater, the coating liquid A flows out at flow rate fed controlled by control pump 6A in such a manner as to feed back the values of flow rate meter 31A. Incidentally, it is allowed to be an open control using only the number of rotation in which a quantitative pump is used for pump controlling A coating liquid used for a middle coating layer (hereinafter, abbreviated as "coating liquid B") is fed to coater B from coating liquid tank 2B by means of the same mechanism as coating liquid A. Coating liquid 8 flows out from slit outlet 9B for the middle layer coating liquid under controlled flow amount fed controlled by control pump 6B in such a manner as to feed back the value of flow rate meter 31B. A coating liquid used for a uppermost coating layer (hereinafter, abbreviated as "coating liquid C") is fed to coater 8 from coating liquid tank 2C by means of the same mechanism as coating liquid A. Coating liquid B flows out from slit outlet 9C for the middle layer coating liquid in such a manner as to feed back the value of flow rate meter 31C under controlled flow amount fed controlled by control pump 6C.

Incidentally, the coating flow rate of coating liquid A was 2.7 liter/min., that of coating liquid B was 2.5 liter/min. and that of coating liquid C was 2.3 liter/min. Control data for controlling aforesaid coating flow rate and feeding flow rate by each control pump are stored in control device 10.

A coater position control means (not illustrated) causes advancing coater 8 to a coater coating position which is a position of the coater when coater 8 coats coating liquid onto base 15. And cause retreating coater 8 from the coater coating position. Aforesaid coater position control means causes coater 8 retreating from the coater coating position until the coating starting point of base 15, which is a leading point of an area where coating liquids A, B and C are coated at prescribed coating flow rate, reaches coater 8, and causes coater 8 advancing to the coater coating position.

As a coater position control means, a means in which a motor activates it and position and timing are controlled mechanically and a means in which a motor activates and position and timing are controlled by means of a computer are considered. In addition, as a means for conveying a base member, a device to convey the base member by rotating a roller such as a back roller by means of a motor and a device to convey a coated means by floating a base by spraying air.

Below coater 8, chamber 11 is provided integrally with coater 8. Aforesaid chamber 11 evacuates the trailing end of a bead when coating liquids are coated onto base 15 from coater 8.

At the leading end of base 15, base 30 for leader for conveying base 15 along with a conveyance path is connected to base 15 by means of adhesive tape 16 whose surface is silver. In the present embodiment, aforesaid silver adhesive tape 16 exhibits the coating starting point of base 15.

Upstream side of the conveyance direction of base 15 from coater 8, and near the conveyance path of base 15, infrared beam sensor 12 which senses silver adhesive tape 16 by means of reflection of an infrared beam. Aforesaid infrared beam sensor 12 is the coating starting point sensing means which senses the coating starting point.

Next, procedure when coating is started in the first control example in coating system 1 of the present embodiment will be explained. Initially, coater 8 is withdrawn from the coating position. Next, as shown in a graph in FIG. 3(*a*), coating liquids A, B and C are coated onto coater 8 at a relatively high flow rate of 3.0 liter/min. Due to this, before coating liquids A, B and C, they are difficult to mix with washing water. Washing water can be pushed out from the liquid feeding tube.

After coating liquids A, B and C were fed from the outlet port for a coater slit, feeding flow rate of the coating liquids fed to coater 8 was reduced to 1.0 liter/min. from 3.0 liter/min. by means of a control pump (see FIG. 3(*a*), numerals 27 and 28). After reducing the feeding flow rate of the coating liquids, coating preparation operations of coater 8 such as equalization of the slit outlet port in such a manner that the coating liquids is uniformly coated from slit outlet ports 9A, 9B and 9C of coater 8 and cleaning of the drop of excessive coating liquid from lip 18 of coater 8 are conducted. During the coating preparation operations, loss of the coating liquids can be reduced by setting the flow rate of the coating liquid fed from coater 8 to be lower compared with ordinary coating flow rate.

While the coating liquids are fed at high flow rate and during coating preparation operation, as shown in FIG. 1, the coating liquids fed from coater 8 are collected by means of chamber 11, and led to a discharge path.

After the coating preparation operation is finished, base 30 for leader is bridged over back roll 13 and conveyance roller 14, and then passed to the conveyance path. By means of back roll 13 and conveyance roller 14 base 30 for leader is started to be conveyed. Following the conveyance of base 30 for leader, base 15 connected to base 30 for leader is started to be conveyed (see FIG. 3(*b*), numeral 29). Soon later, base 15 is conveyed at a prescribed conveyance speed (see FIG. 3(*b*), 39).

Base 30 for leader and base 15 are conveyed. By means of infrared beam sensor 12 in the coating starting point sensing means, silver adhesive tape 16 is sensed (see FIG. 3(*a*), numeral 25).

As a coating starting point sensing means, an infrared beam sensor, a light sensing means and a pressure sensor when the coating starting point is shown by a hole or a protrusion can be used.

When infrared beam sensor 12 senses silver adhesive tape 16, a sensing signal is sent to control device 10. Control device 10 calculates time when the coating starting point exhibited by silver adhesive tape 16 reaches coater 8 from the current conveyance speed base 15, distance between a sensing position by means of infrared beam sensor 12 and coater 8 and time when silver adhesive tape 16 was sensed by means of infrared sensor 12. In the present embodiment, five minutes after silver adhesive tape 16 was sensed by infrared beam sensor 12, the coating starting point reaches coater 8. Time calculated by control device 10 is five minutes after sensing silver adhesive tape 16 by infrared beam sensor 12.

As described above, it is allowed that time until flow rate is changed after sensing the coating starting point is sense is set in advance if the conveyance speed is almost constant, while time is not required in accordance with the conveyance speed.

Accordingly, five minutes after infrared beam sensor 12 senses silver adhesive tape 16 which exhibits the coating starting point, a coater position control means (not illustrated) causes coater 8 to advance to a coating position at which the coating liquids are coated onto base 15, and as shown in FIG. 2, coater 8 moves in such a manner that it approximately closes to back roll 13 to be positioned at the coating position. Since time necessary for rising up from the initial flow rate (1 liter/min.) to each of coating flow rate (2.7, 2.5 and 2.3 liter/min.) is within 30 sec., control device 10 designates to the control pump that coating flow rate is increased 4 minutes and 30 seconds after sensing adhesive tape 16.

Feeding flow rate of coating liquid A to coater 8 was increased from 1.0 liter/min. to 2.7 liter/min. which is coating flow rate. Concurrently, feeding flow rate of coating liquid B to coater 8 was increased from 1.0 liter/min. to 2.5 liter/min. which is coating flow rate. Concurrently, feeding flow rate of coating liquid A to coater 8 was increased from 1.0 liter/min. to 2.3 liter/min. which is coating flow rate.

As a feeding flow rate control means, a combination of a device which changes the feeding amount of the coating liquid actually such as a pump and a device to control feeding amount and timing mechanically and a combination of a device which changes the feeding amount of the coating liquid actually such as a pump and a device to control timing such as a computer.

As described above, according to the first control example of coating system 1 of the present embodiment, when coating starting point reaches coater 8, feeding flow rate of the coating liquids with plural layers at coater 8 is increased to coating flow rate simultaneously for all layers. Therefore, when the coating starting point reaches coater 8, coating with the coating flow rate can be started simultaneously for all layers.

Coating liquids flowed out from each slit outlet port 9A, 9B and 9C on coater 8 are superposed on an oblique surface of coater 8 for forming plural layers. Aforesaid plural layers are fed to base 15 on back roller 13 from lip 18 of coater 8. Thus, a coating liquid with plural layers is coated on base 15. Then, base 15 on which plural coating layers have been coated is conveyed to a drying step by means of conveyance roller 14.

Incidentally, if plural layers are coated, it is allowed for several of aforesaid plural layers or only one layer to change flow rate from low to ordinary, while the flow rate of all layers are not changed from low to ordinary. If the flow rate of several of aforesaid plural layers are changed from low to ordinary, aforesaid layers are preferable to be emulsion layers containing silver. In addition, flow rate of the outermost layer may have an ordinary coating flow rate constantly.

Next, the second control example of coating system 1 of the present embodiment will be explained. In the second control example of coating system 1 of the present embodiment, when the coating starting point of base 15 reaches coater 8, feeding flow rate of coating liquids A, B and C composing plural layers at coater 8 reaches coating flow rate. Simultaneously, speed to increase feeding flow rate of coating liquid A to coater 8 and timing to start increasing aforesaid speed, speed to increase feeding flow rate of coating liquid B to coater 8 and timing to start increasing aforesaid speed and speed to increase feeding flow rate of coating liquid C to coater 8 and timing to start increasing aforesaid speed were changed as shown in FIG. 4. As described above, in the present embodiment, if the feeding flow rate of the coating liquid with plural layers at coater 8 has reached the coating flow rate when the coating starting point of base 15 reaches coater 8, speed to increase feeding flow rate of coating liquids to coater 8 and timing to start increasing aforesaid speed may be different.

In addition, feeding flow rate of the coating liquids A and B may be changed as shown in the first control example or the second control example, while the feeding flow rate of coating liquid C, coating liquid for the uppermost layer, may be kept as the coating flow rate. Due to this, while preventing pulling phenomenon on the uppermost layer, feeding flow rate of coating liquids A and B composing plural layers other than the uppermost layer is reduced compared with the coating flow rate. Therefore, loss of coating liquids A and B until the coating starting point of base 15 can simply be decreased.

Owing to the present invention, loss of the coating liquid between the coating preparation operation is conducted until the coating starting point of the base member reaches the coater.

What is claimed is:

1. A method of coating, at a regular flow rate, a plurality of coating solutions onto a base member by a coater, thereby to form simultaneously a plurality of layers on said base member while conveying said base member along a path, said base member having a starting point from which said coating onto said base member starts, said method comprising feeding at least one of said plurality of coating solutions to said coater at a first flow rate so as to discharge at least one of said plurality of coating solutions through said coater at said first flow rate, changing, without interruption in flow, said first flow rate to a second flow rate, which is less than said first flow rate, so as to discharge said at least one of said plurality of coating solutions through said coater at said second flow rate;

changing said second flow rate to said regular flow rate so as to coat said at least one of said plurality of coating solutions onto said base member at said regular flow rate in accordance with a conveyed position of said starting point which is being conveyed along said path to said coater, said second flow rate being greater than zero and less than said regular flow rate.

2. The method of claim 1 wherein said at least one of said coating solutions is for other than an outermost layers of said plurality of layers.

3. The method of claim 1 wherein said second flow rate is changed to said regular flow rate when said coater is shifted from a non-coating position to a coating position.

4. The method of claim 3 comprising shifting said coater from said non-coating position to said coating position in response to detecting a mark indicating said starting point.

5. The method of claim 1 wherein said starting point is predetermined and a mark indicating said starting point is applied to said base member.

6. The method of claim 5 wherein said second flow rate increases to said regular flow rate in response to detecting said mark.

7. The method of claim 1 wherein said starting point is adjacent a junction of said base member and a leader connected to said base member.

8. The method of claim 1 wherein said starting point is determined by a predetermined conveyance distance through which said base member is conveyed.

9. The method of claim 1 wherein all flow rates of said plurality of coating solutions being changed to said regular flow rate at one time.

10. The method of claim 1 wherein all of said plurality of layers are coated on said base member simultaneously, flow rates of coating solutions for less than all of said plurality of layers being unchanged when said starting point is conveyed along said path to said coater.

11. The method of claim 1 wherein at least one said coating solution contains silver halide grains.

12. The method of claim 1 wherein coating preparation is conducted during feeding of at least one of said plurality of coating solutions to said coater at said second flow rate.

13. The method of claim 12 wherein said at least one of said plurality of coating solutions contains silver halide grains.

14. The method of claim 12 wherein said at least one of said plurality of coating solutions is for other than an outermost layer of said plurality of layers.

15. The method of claim 12 wherein said second flow rate is changed to said regular flow rate when said coater is shifted from a non-coating position to a coating position.

16. The method of claim 15 comprising shifting said coater from said non-coating position to said coating position in response to detecting a mark indicating said starting position.

17. The method of claim 12 wherein said starting point is predetermined and a mark indicating said starting point is applied to on said base member.

18. The method of claim 17 wherein said second flow rate increases to said regular flow rate in response to detecting said mark.

19. The method of claim 12 wherein said starting point is adjacent a junction of said base member and a leader connected to said base member.

20. The method of claim 12 wherein all of said plurality of layers is coated on said base member simultaneously, flow rates of coating solutions for less than all of said plurality of layers being unchanged when said starting point is conveyed along said path to said coater.

21. The method of claim 12 wherein said coating preparation comprises equalization of said coating solution at a slit outlet so that said coating solution is uniformly supplied from said slit outlet.

22. The method of claim 21 wherein said coating preparation comprises cleaning excessive coating solution from a lip of said coater.

23. The method of claim 12 wherein said starting point is determined by a predetermined conveyance distance through which said base member is to be conveyed and a conveyance speed thereof.

24. The method of claim 12 wherein all of plurality of layers are coated on said base member simultaneously, all flow rates of coating solutions for said plurality of layers being changed to said regular flow rates at one time.

25. A method of coating, at a regular flow rate, a plurality of coating solutions onto a base member by a coater, thereby to form simultaneously a plurality of layers on said base member while conveying said base member along a path, said base member having a starting point from which said coating onto said base member starts, said method comprising feeding at least one of said plurality of coating solutions to said coater at a first flow rate so as to discharge at least one of said plurality of coating solutions through said coater at said first flow rate, changing, without interruption in flow, said first flow rate to a second flow rate, which is less than said first flow rate, so as to discharge said at least one of said plurality of coating solutions through said coater at said second flow rate;

changing said second flow rate to said regular flow rate so as to coat said at least one of said plurality of coating solutions onto said base member at said regular flow rate in accordance with a conveyed position of said starting point which is being conveyed along said path to said coater, said second flow rate being greater than zero and less than said regular flow rate, and said first flow rate is greater than said regular flow rate.

* * * * *